US008910561B2

(12) United States Patent
Plaxats Oller

(10) Patent No.: US 8,910,561 B2
(45) Date of Patent: Dec. 16, 2014

(54) SEMI-AUTOMATIC PISTOL WITH A SLIDING BARREL

(76) Inventor: Salvador Plaxats Oller, Nerja (ES)

( * ) Notice: Subject to any disclaimer, the term of this patent is extended or adjusted under 35 U.S.C. 154(b) by 62 days.

(21) Appl. No.: 13/879,063

(22) PCT Filed: Oct. 6, 2011

(86) PCT No.: PCT/EP2011/067505
§ 371 (c)(1),
(2), (4) Date: Apr. 12, 2013

(87) PCT Pub. No.: WO2012/049072
PCT Pub. Date: Apr. 19, 2012

(65) Prior Publication Data

US 2013/0192452 A1 Aug. 1, 2013

(30) Foreign Application Priority Data

Oct. 13, 2010 (FR) ..... 10 58336

(51) Int. Cl.
*F41A 5/16* (2006.01)

(52) U.S. Cl.
CPC ..... *F41A 5/16* (2013.01)
USPC ..... 89/161; 89/139; 89/143; 89/154

(58) Field of Classification Search
CPC ..... F41A 5/15; F41A 3/16; F41A 3/26
USPC ..... 89/161, 139, 143, 144, 154
See application file for complete search history.

(56) References Cited

U.S. PATENT DOCUMENTS

| | | | | |
|---|---|---|---|---|
| 663,955 | A | 12/1900 | Burgess | |
| 663,956 | A | 12/1900 | Burgess | |
| 1,376,456 | A | 5/1921 | Moore | |
| 5,939,659 | A | 8/1999 | Dobbins | |
| 2006/0048426 | A1 * | 3/2006 | Crandall | 42/69.01 |
| 2006/0048427 | A1 * | 3/2006 | Crandall et al. | 42/69.01 |
| 2006/0048429 | A1 * | 3/2006 | Crandall et al. | 42/71.01 |
| 2007/0240351 | A1 * | 10/2007 | Maldonado Ferreira Lopes | 42/8 |
| 2008/0000128 | A1 * | 1/2008 | Newman | 42/16 |
| 2010/0212203 | A1 * | 8/2010 | McGarry | 42/71.02 |
| 2010/0236121 | A1 * | 9/2010 | McGarry | 42/69.02 |
| 2011/0219656 | A1 * | 9/2011 | McGarry | 42/70.06 |
| 2012/0023801 | A1 * | 2/2012 | Rozum et al. | 42/70.08 |

(Continued)

FOREIGN PATENT DOCUMENTS

| | | | |
|---|---|---|---|
| DE | 518 372 | C | 2/1931 |
| GB | 493 556 | A | 10/1938 |

*Primary Examiner* — Michael David
(74) *Attorney, Agent, or Firm* — McGlew and Tuttle, P.C.

(57) ABSTRACT

The pistol comprises a frame (1) containing a barrel (4) slidably mounted. The pistol further comprises a firing mechanism comprising a hammer (11) mounted so that it can pivot at the rear of the pistol, and a trigger (10) secured to an actuating arm (15) that acts on means (19) of arming the hammer (11) and retaining it in the armed position. The means for arming and retaining the hammer (11) comprise a link (19) directly connected to the hammer (11) by an articulation (20) and which is actuated via a lever (40) pivot-mounted in the frame (1). The lever has a top end actuated by the barrel as the latter moves into its forward position in order to cause the lever (40) to pivot, and a bottom end acting like a cam on the link (19) by pushing it backwards in order to rearm the hammer (11).

18 Claims, 5 Drawing Sheets

(56) References Cited

U.S. PATENT DOCUMENTS

Figure 1:
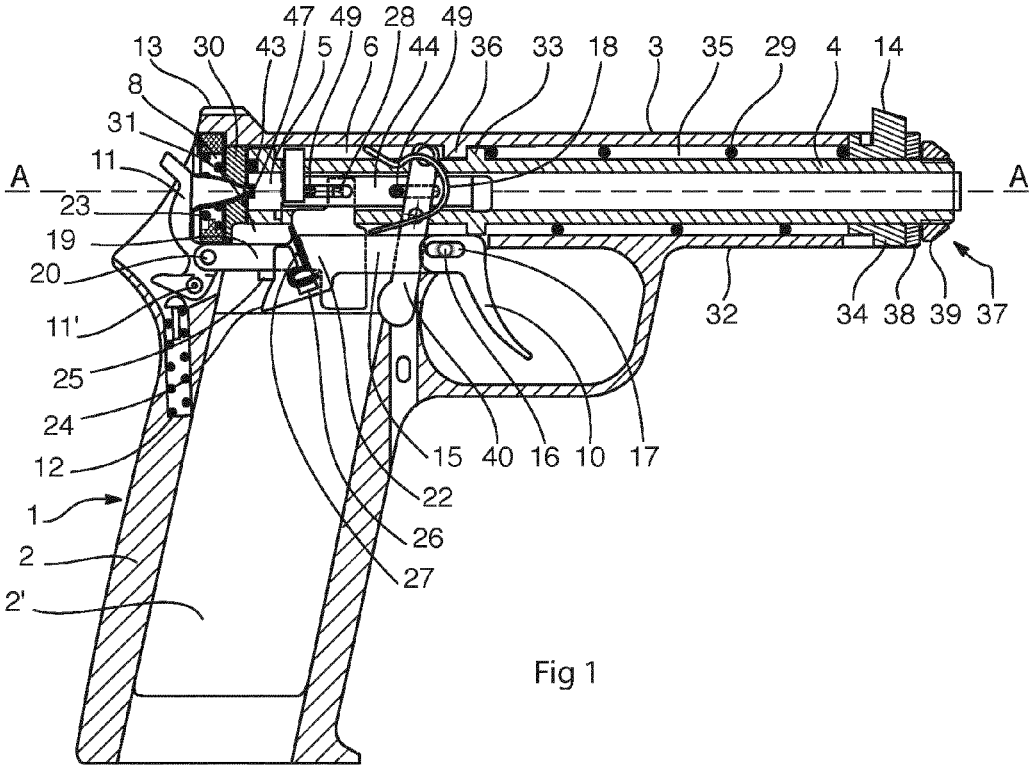

2012/0297971 A1* 11/2012 Lester ..... 89/198
2013/0019510 A1* 1/2013 Kemmerer et al. ..... 42/1.01
2013/0174457 A1* 7/2013 Gangl et al. ..... 42/16

* cited by examiner

SEMI-AUTOMATIC PISTOL WITH A SLIDING BARREL

The present invention relates to a semi-automatic pistol with a sliding barrel.

A pistol is defined as being semi-automatic because it is provided with a magazine from which a new cartridge is automatically loaded after each shot, while it is necessary to press again the trigger for firing each cartridge until the magazine is out of bullets.

A conventional semi-automatic pistol comprises a frame wherein there is arranged a barrel. The back end of the barrel forms a firing or combustion chamber associated with a receiving cavity for receiving a cartridge having a downwards opening to receive a magazine, and a side opening associated with a mechanism for extracting and ejecting the cartridge case after shooting.

The upper portion of the frame of a conventional pistol is covered by means of a slidably mounted grip extending along the barrel which is connected to the frame. The grip comprises a firing pin associated with a hammer or striker mounted so that it can pivot in the rear portion of the pistol. The firing pin has the shape of a needle mounted such that it is axially movable inside the grip in order to transmit the striking of the striker to a cartridge housed inside the firing chamber at the back end of the barrel.

While shooting, the grip is kicked back due to combustion gases that create an important pressure inside the barrel. A recoil spring compressed during the recoil of the grip then returns it to its initial position after extracting and ejecting the case, which allows mounting a new cartridge inside the receiving cavity and then moving it axially passing over a ramp to be housed inside the chamber of the barrel.

With respect to conventional pistols, one of the advantages of a semi-automatic pistol with a sliding barrel is based on the fact that it allows, for a given overall length, housing a barrel of a length that is considerably increased with respect to the length of the barrel of a conventional pistol. A longer barrel provides improved precision. Such a pistol can therefore be more compact for the same barrel length.

A semi-automatic pistol with a sliding barrel is known from U.S. Pat. No. 1,376,456. Nevertheless, the pistol described therein comprises a large number of parts that are hard to manufacture and to put into practice. The guiding of the barrel in the frame is not optimal either because it is done on only one side of the barrel.

An objective of the invention is to simplify the construction of the pistol by means of reducing the number of parts necessary for the correct operation of the pistol, which also entails a considerably lower manufacturing cost. This particularly relates to the mechanism for rearming and retaining the striker in its armed position, which becomes extremely reliable as a result of the invention.

The objective of the invention is a semi-automatic pistol comprising a frame wherein there is arranged a barrel the firing chamber of which is associated with a receiving cavity for receiving a cartridge, said receiving cavity being provided with a downwards opening to communicate with a magazine, and with a side ejection port associated with a mechanism for extracting and ejecting the case after shooting, the pistol further comprising a firing mechanism comprising a striker mounted so that it can pivot in the rear portion of the pistol and suitable to initiate firing a cartridge inside the firing chamber, and a trigger integral with an actuating arm which acts on means for arming and retaining the striker in the armed position, wherein the barrel is mounted in an axially slidable manner between a forward position to which it is driven by the friction of the bullet when shooting a cartridge, and a recoiled position to which it is pushed by a recoil spring until reloading a new cartridge, characterized in that said means for arming and retaining the striker comprise a link which at its back end is connected to the striker by an articulation and which is operated by means of a lever pivotably mounted inside the frame, said lever having a top end operated by the barrel during the movement of the barrel to its forward position in order to pivot said lever, and a bottom end forming a cam that acts on said link during the pivoting of said lever, pushing it back so as to rearm the striker.

According to other features of the invention:

- the barrel acts on said top end of said pivoting lever by means of a projection provided at its back end hitting against said pivoting lever such that it is pivoted forward;
- said link is provided with an L-shaped guiding slot the large side of which extends horizontally and the small side of which extends vertically upwards, a guiding pin incorporated in the frame extending inside said L-shaped guiding slot such that it allows the link to carry out a translatory motion towards the back for the purpose of arming the striker while at the same time it is subjected to the effect of the action of a spring that downwardly bias it such that said pin is housed inside said small side so as to retain said link in an armed position of the striker;
- said link can be released from said armed position by means of a nose which forms a cam provided at the back end of the actuating arm and which is suitable for abutting on the underside against the link to push it upwards;
- said actuating arm incorporates an elastic member which projects upwards and during the pivoting thereof abuts against a lug provided on said link such that together they form a flexible stop;
- said elastic member is a wire spring;
- a rear wall of the receiving cavity for receiving a cartridge is provided with a hole centered on the firing chamber and which allows the striker to strike a cartridge inside the firing chamber directly through said hole;
- the striking end of the striker has an overall conical shape complementary to the inner shape of said hole;
- the barrel slides inside a cylindrical gap formed inside the frame being guided by a collar provided on the periphery of the barrel and by an end part with a central guiding bore arranged in the front end of the pistol;
- the recoil spring is a helicoidal spring arranged inside an annular interstice formed between said cylindrical gap and the barrel being supported on said collar of the barrel on one side and on said end part on the other side;
- the mechanism for extracting and ejecting the case after shooting comprises an ejector plate arranged opposite the ejection port and one of the ends of which is connected to the barrel and the other end of which has an elastic loop that extends radially and is suitable for being compressed by the cartridge as the cartridge moves up into the receiving cavity for receiving the cartridge;
- the ejector plate has at least one longitudinal guiding slot that receives a guiding pin so as to limit its axial movement to an ejection position;
- in order to center the cartridge as it moves up into the receiving cavity, the rear wall of said cavity is provided with a first lug arranged so as to form an upper abutment, and with a second lug arranged so as to form a side abutment;
- said second lug is provided with a projection suitable for being placed behind a ridge of the cartridge so as to form a member for extracting the case after shooting;

the magazine is closed at its top end by a rotary closure member having the shape of a stirrup two parallel sides of which are shown to be pivoting on the top end of the magazine;

one of the sides of the stirrup incorporates a leg directed downwards to penetrate a guiding slot provided at the top end of the magazine, and it is suitable for cooperating with an elastic member provided inside the gap for receiving the magazine for the purpose of pivoting the rotary closure member to its open position;

an abutment member in the form of a shaft is mounted such that it slides upwards and downwards to project into the receiving cavity when it is in an upper position, such that it prevents the barrel from returning to its recoiled position so that the ejection port is kept open towards the receiving cavity; and the shaft forming an abutment is arranged in front of the magazine and comprises at its top end a ho ok projecting into a slot of the magazine to cooperate with a raising plate for raising the cartridges in order to move the shaft upwards after shooting the last cartridge inside the magazine.

Figures 2A, 2B:
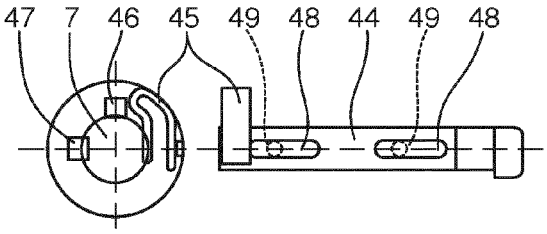
Figure 3:
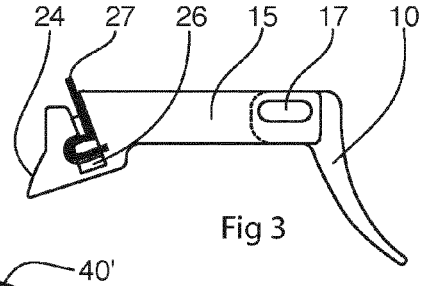
Figure 4:
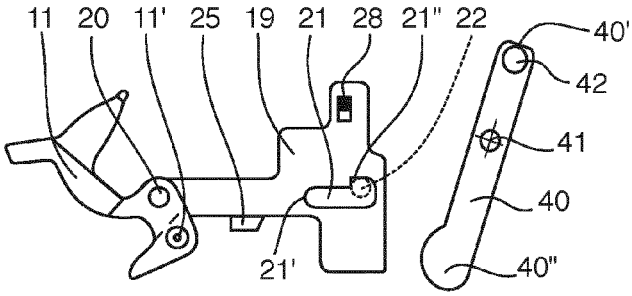
Figure 5:
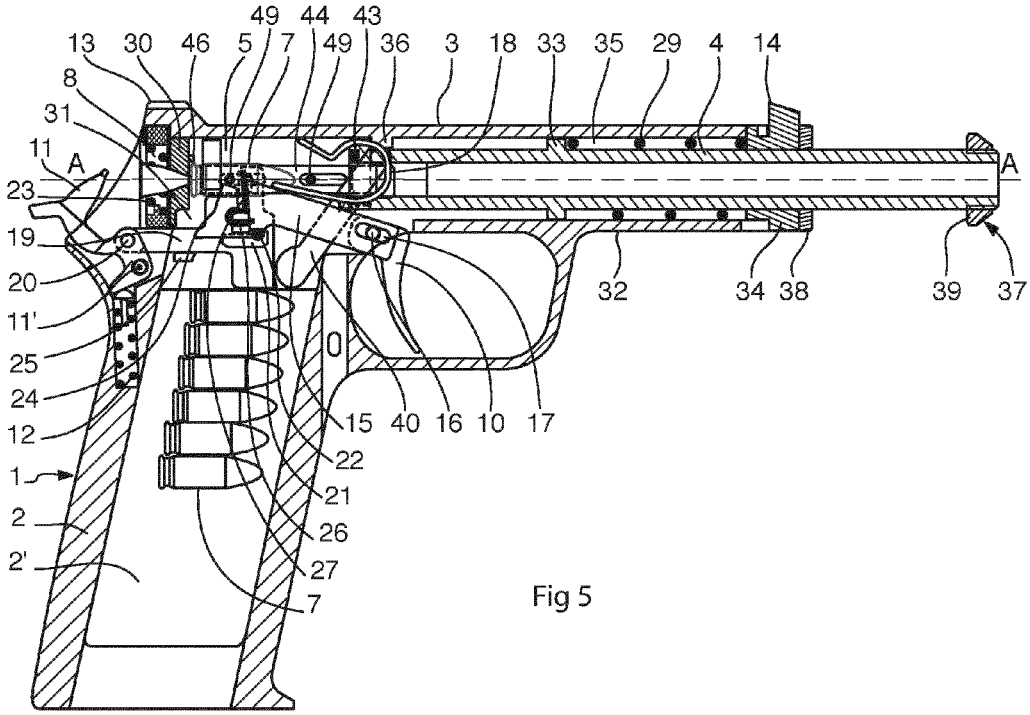
Figure 6:
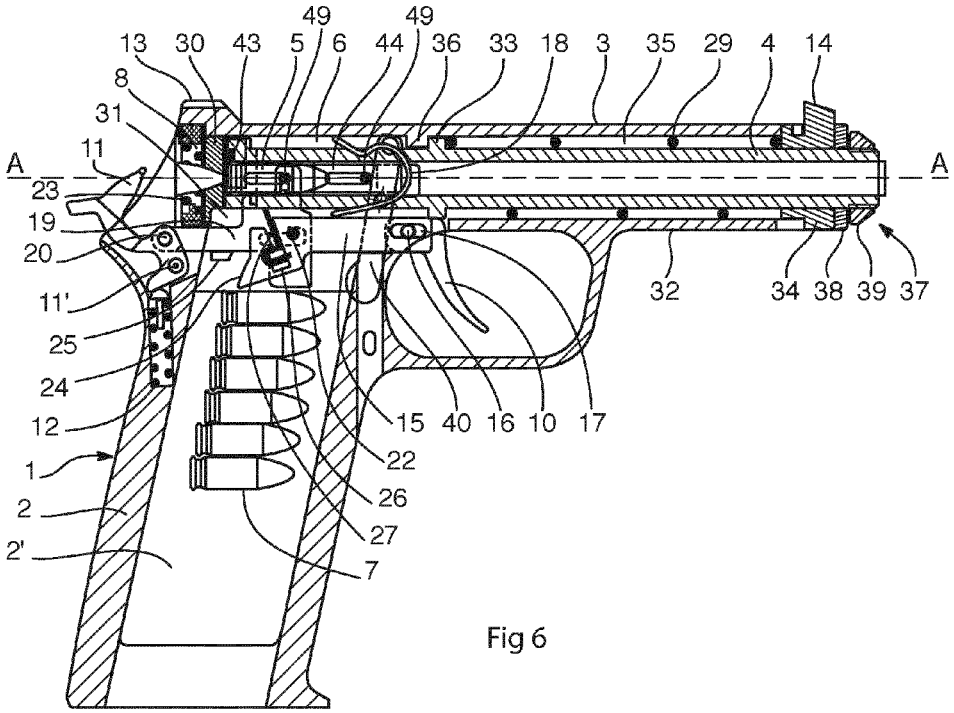
Figure 7:
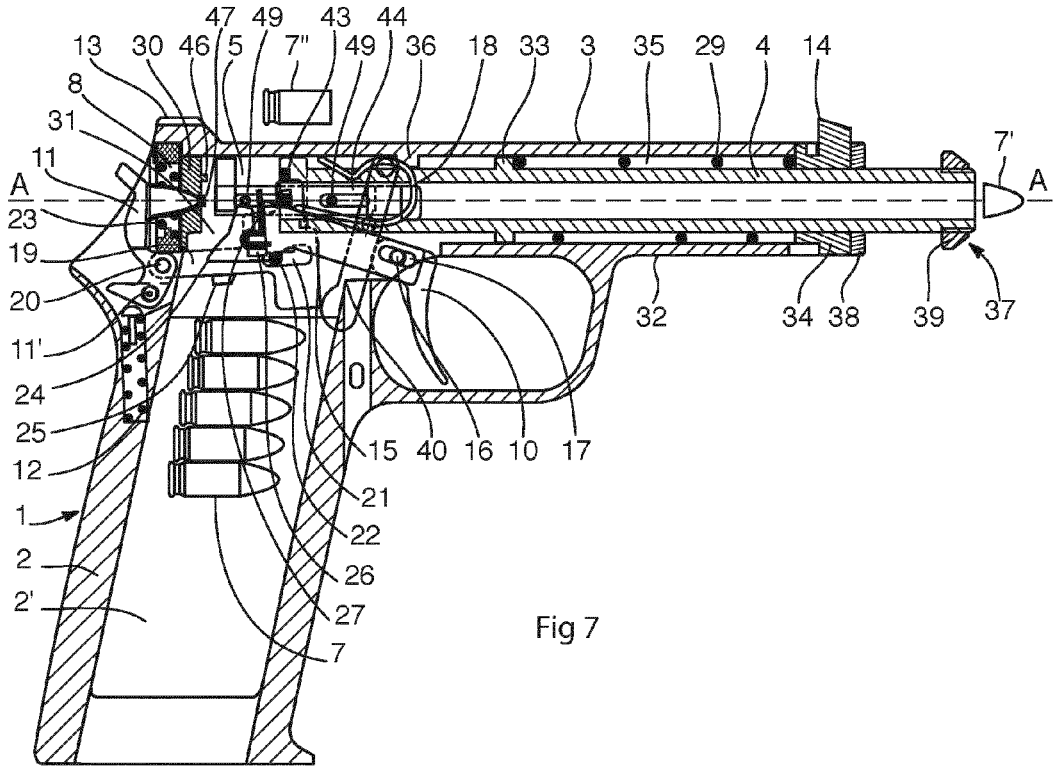
Figure 8:
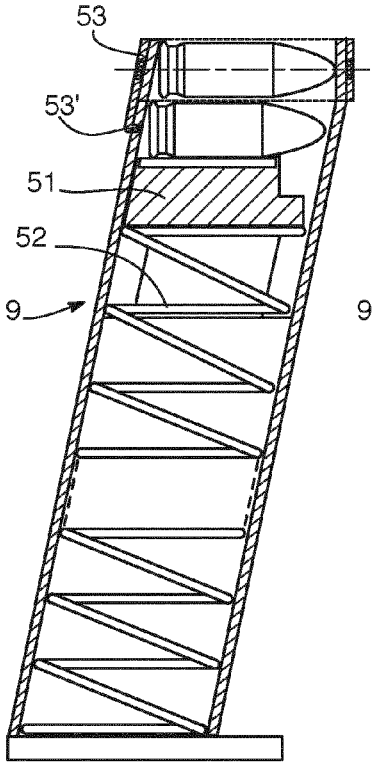
Figure 9:
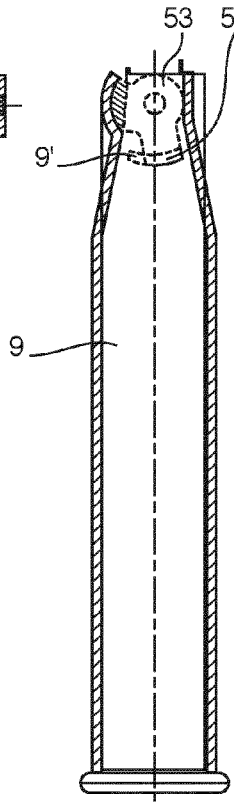
Figure 10:
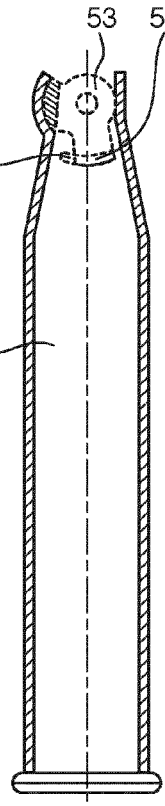
Figure 11:
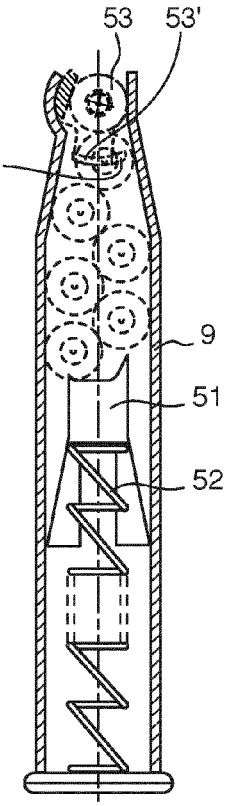
Figure 12:
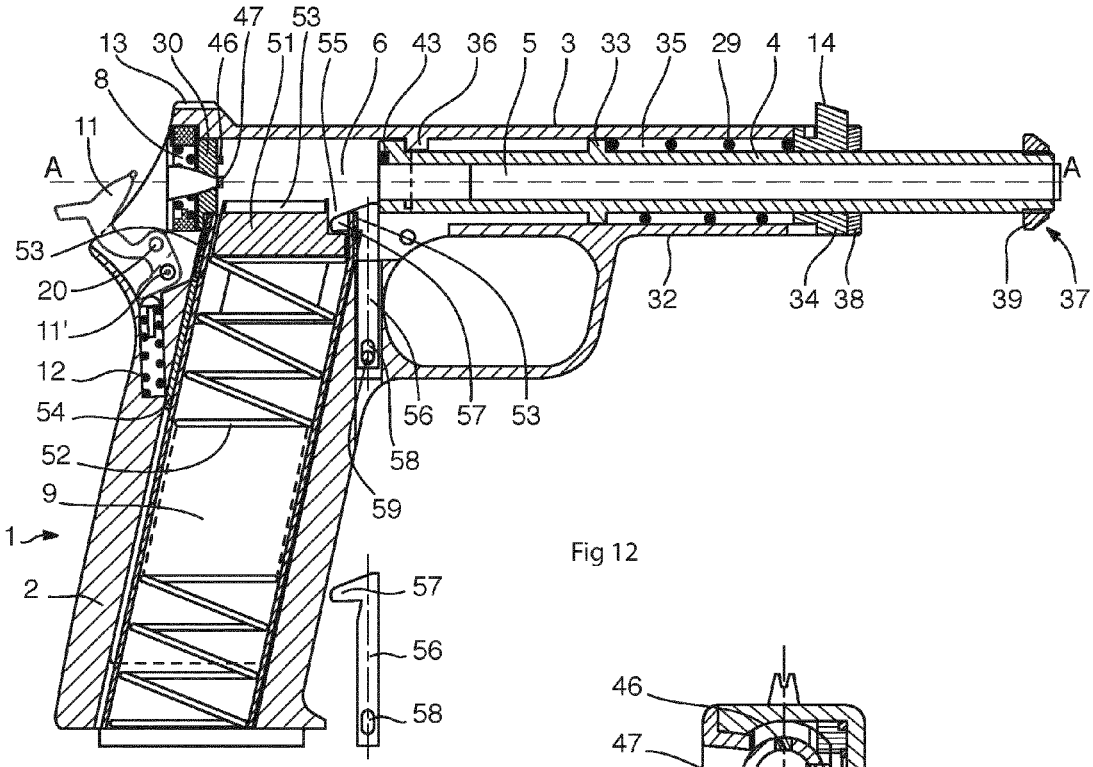
Figure 15A:
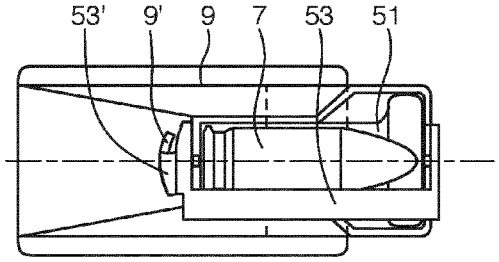
Figure 15B:
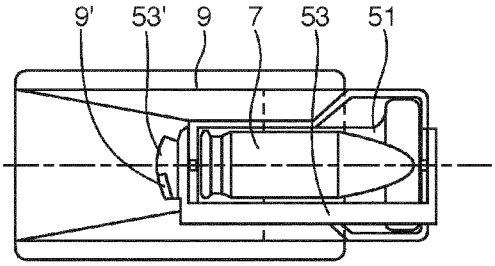
Figure 13:
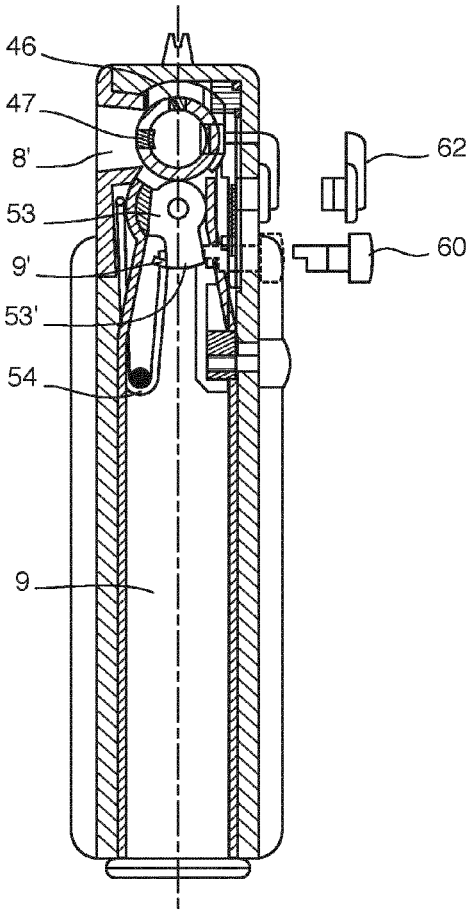
Figure 14:
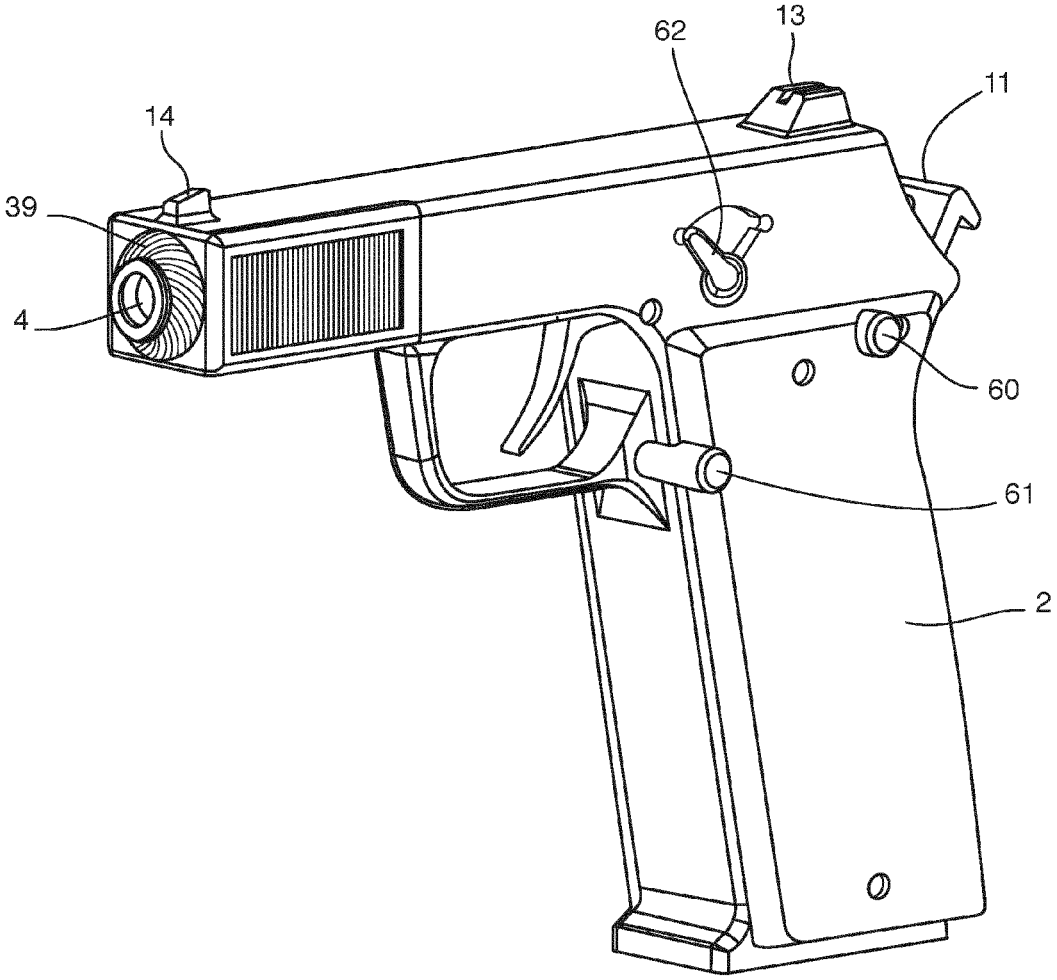

Other features and advantages of the invention will become evident from the following description of a non-limiting embodiment of the invention in reference to the attached drawings in which:

FIG. 1 is a longitudinal cross-section of a pistol according to the invention in its standby position, without a cartridge, FIG. 2*a* is a side view of an ejector plate according to the invention, FIG. 2*b* is a schematic end view showing the case of a cartridge supported against the ejector plate of FIG. 2*a* which is arranged opposite a lug for extracting the case, FIG. 3 shows the trigger associated with an actuating arm of the firing mechanism, FIG. 4 shows the striker connected to a link forming a member for arming and retaining the striker in its armed position on the left and a pivoting lever for automatically rearming the striker by acting on the link on the right, FIGS. 5 to 7 are schematic longitudinal cross-sections illustrating the operation of the pistol according to the invention, FIG. 5 shows the arming, FIG. 6 shows the armed striker ready to strike a cartridge inside the firing chamber, and FIG. 7 shows the striking and the ejection of the bullet, FIGS. 8 to 11 are cross-section views showing the details of a magazine according to the invention, FIG. 12 is a longitudinal cross-section view illustrating the operation of an abutment which stops the return of the barrel when the magazine is empty, FIG. 13 is a cross-section view showing a magazine in place inside the butt of the pistol, FIG. 14 is a perspective view showing the location of control members of safety devices, FIG. 15A is a top view of a magazine showing a rotary closure member in its closed position, and FIG. 15B is a top view of a magazine showing a rotary closure member in its open position.

Identical or equivalent elements have the same reference signs in the drawings.

In the longitudinal cross-section of the pistol of FIG. 1, the essential elements are shown in their standby position inside the frame 1, before using the pistol.

The frame 1 is made up of a butt 2 inclined towards the back and of an upper portion 3 which extends horizontally extension wherein there is arranged a barrel 4. The back end of the barrel 4 forms a firing or combustion chamber 5 which is associated with a receiving cavity 6 for receiving a cartridge 7 (not depicted in FIG. 1). The cavity 6 is provided with a downwards opening 8 to communicate with a magazine 9 (illustrated in FIGS. 8 to 13) and with a side ejection port 8' (see FIG. 13) associated with a mechanism for extracting and ejecting the case 7" after shooting. This mechanism will be explained in detail below.

The pistol also comprises a firing mechanism comprising a trigger 10 connected to means for arming and retaining a striker 11 mounted so that it can pivot on a shaft 11' in the rear portion of the pistol. A spring 12 is arranged such that it abuts against the bottom end of the striker 11 to act on it towards the position shown in FIG. 1.

To aim before shooting, the pistol is also provided, in a conventional manner, with a sight notch 13 located towards the rear and of a foresight 14 located towards the front on the upper face of the pistol.

The trigger 10 is integral with an actuating arm 15. The trigger-actuating arm assembly is mounted so that it can pivot about a shaft 16 extending inside an oblong bore 17 inside the assembly. The actuating arm 15 is downwardly biased by a wire form spring 18 arranged above the actuating arm 15 one of the ends of which is supported against the upper face of the actuating arm and the other end is supported against the frame 1.

The actuating arm 15 acts on a member for arming and retaining the striker in the armed position, generally referred to as a catch. In the illustrated example, this member is formed by a link 19 which at its back end is directly connected to the striker 11 by means of an articulation 20. The link is provided with an L-shaped guiding slot 21 the large side 21' of which extends horizontally and the small side 21" of which extends vertically upwards (see FIG. 4). A guiding pin 22 incorporated in the frame 1 extends inside the L-shaped guiding slot 21 such that it allows the link 19 to carry out a translatory motion towards the back for the purpose of arming the striker 11.

At the end of this translatory motion towards the back, the link 19 can move slightly downwards by the effect of the action of a pressure spring 23 such that the guiding pin 22 is housed in the small side 21" of the guiding slot 21 so as to retain the link 19 to lock the striker 11 in its armed position.

One of the ends of the pressure spring 23 is supported against the upper surface of the rear portion of the link 19 to downwardly bias it for the purpose of keeping the pin 22 in the small side in its upper locking position (see FIG. 1).

To push the link upwards again such that it makes the pin 22 enter the long side of the L-shaped guiding slot 21, the actuating arm 15 is provided at its back end with a nose which forms a cam 24 intended for being supported on a lug 25 provided on a lower edge of the link 19 when the back end of the actuating arm 15 is pivoted upwards after pressing the trigger 10. The link 19 is thus released from its position for retaining the striker 11 and moves forward for the purpose of allowing the striker to pivot in order to trigger the shot.

The actuating arm 15 is furthermore, near the cam 24, provided with a groove 26 wherein there is housed an elastic member in the form of a wire spring 27 which, during the pivoting of the actuating arm 15, abuts against a lug 28 arranged above on the link 19, above the L-shaped slot 21. This spring 27 thus forms a flexible stop together with the lug 28.

The barrel 4 is mounted in an axially slidable manner for moving between a forward position to which it is driven by the friction of the bullet 7' when shooting a cartridge 7, and a recoiled position to which it is pushed by a recoil spring 29 that is compressed by the barrel 4 during its movement towards the forward position. The barrel 4 recoils until reloading a new cartridge 7 which has previously been mounted from the magazine into the receiving cavity 6 during the movement of the barrel 4 towards its forward position.

During its movement towards the recoiled position, the barrel 4 is pushed effectively until being supported against a rear wall 30 of the receiving cavity 6 and the new cartridge 7 is thus automatically located inside the firing chamber 5 of the barrel 4, without having to move it longitudinally, as is the case in conventional pistols. More precisely, the cartridge 7 always moves up parallel to axis A-A of the barrel 4 and is also stored parallel to this axis inside the magazine.

In a conventional fixed-barrel pistol, the cartridges are stored, in contrast, inclined inside the magazine for the purpose of facilitating their passage over a ramp in order to move longitudinally towards the firing chamber. One of the advantages of the pistol with a sliding barrel is that the longitudinal movement of the cartridge towards the firing chamber is eliminated, and therefore no ramp is necessary, which excludes the risk of the cartridge becoming jammed during such movement in the longitudinal direction.

The barrel 4 can recoil to the rear wall of the receiving cavity 6 for receiving the cartridge 7, and it is therefore possible to arrange in the frame 1 a barrel 4 having a length that is considerably increased with respect to the length of a barrel in a conventional fixed-barrel pistol having the same overall length. This increased length can clearly be seen when comparing FIGS. 1 and 5, the latter figure showing the barrel 4 in its forward position.

By way of example, for an overall pistol length of 183 mm, a conventional fixed-barrel pistol has a barrel length of approximately 97 mm, whereas the pistol according to the invention will have a barrel length of approximately 155 mm. As previously mentioned, an increased barrel length provides greater shot precision.

The rear wall 30 of the receiving cavity 6 of the cartridge 7 is provided with a hole 31 centered on the firing chamber 5 of the barrel 4. This hole 31 allows the striker 11 to strike a cartridge located inside the firing chamber 5, and which is then supported against this rear wall 30, directly through this hole 31.

This arrangement, which is a logical consequence of the fact that the firing chamber 5 is supported against the rear wall 30 of the receiving cavity 6 for receiving the cartridge 7 when shooting, allows eliminating the firing pin which is necessary in conventional pistols. In this regard, the pistol according to the invention works like a revolver wherein the striker strikes the cartridge directly.

For the purpose of optimizing the striking precision, the striking end of the striker 11 has an overall conical shape complementary to the inner shape of the hole 31 in the rear wall 30.

According to the invention, the barrel 4 slides inside a cylindrical gap 32 formed inside the frame 1. In its alternating movement between the forward position and the recoiled position, the barrel 4 is guided by a collar 33 provided on the periphery of the barrel and by an end piece 34 with a central guiding bore arranged in the front end of the pistol.

The recoil spring 29 is a helicoidal sp ring arranged inside an annular interstice 35 formed between the cylindrical gap 32 and the barrel. This helicoidal spring is supported on the collar 33 of the barrel 4 on one side and on the end part 34 on the other side.

For the purpose of defining the recoil of the barrel 4 to its recoiled position, a lug 36 is advantageously provided on the inner face of the cylindrical gap 32 so as to form an abutment for the collar 33 of the barrel 4 when it returns to its recoiled position.

For the purpose of locking the barrel 4 in its non-use position shown in FIG. 1, a safe in the form of a locking device 37 for locking the barrel is provided in the front end of the pistol. This device comprises a plate 38 fixed in the front end of the pistol and comprising a central bore associated with a thread to cooperate with a nut 39. The safety device 37 can comprise as a variant a bayonet locking device.

For its automatic rearming, the pistol according to the invention comprises a pivoting lever 40 which acts on the link 19 forming a member for arming and retaining the striker in the armed position.

The lever 40 is pivotably mounted on a rotation shaft 41. The lever 40 has a top end 40' operated by the barrel 4 as it moves to its forward position, and a bottom end 40" having a rounded shape forming a cam arranged opposite the front end of the link 19. The lever 40 is provided at its top end 40' with a lug 42 which, during the forward movement of the barrel 4, is driven by a lug 43 arranged at the back end of the barrel. This causes the pivoting lever 40 to pivot (see FIG. 5) such that its bottom end 40" pushes the link 19 back, which in turn pivots the striker 11 to its armed position while at the same time the link is locked in this position in the manner already described.

The lever 40, as well as the link 19 and the actuating arm 15, can advantageously be manufactured very precisely by laser cutting from a metal sheet.

The pistol is furthermore provided with a mechanism for extracting and ejecting the case 7" after shooting the cartridge 7. This mechanism comprises an ejector plate 44 arranged opposite the ejection port 8' and one of the ends of which is connected to the barrel 4 and the other end of which has an elastic loop 45 that extends radially (see FIGS. 2*a* and 2*b*). This loop 45 is compressed by the cartridge 7 as the cartridge moves up into the receiving cavity 6 of the cartridge.

For the purpose of correctly centering the cartridge 7 as it moves up into the receiving cavity 6, the rear wall 30 of said cavity is provided with a first lug 46 arranged so as to form an upper abutment, and a second lug 47 arranged so as to form a side abutment.

The lug is provide d with a side projection suitable for being located behind a ridge provided on the cap of the case to retain it in place in order to extract it from the chamber 5 when the barrel moves towards its forward position.

The lugs 46 and 47 as well as the loop 45 of the ejector plate 44 are retained in cuts formed on the face of the back end of the barrel 4 to allow said barrel to return towards the rear until it is supported against the rear wall 30 of the receiving cavity 5.

In the illustrated example, the ejector plate 44 has two longitudinal guiding slots 48 that receive a pin 49 projecting from the inner wall of the receiving cavity 6 such that they limit the axial movement of the ejector plate 44 into an extraction position.

Now the operation of the pistol according to the invention will be described in reference to FIG. 1 and FIGS. 5 to 7.

FIG. 1 shows the essential elements of the pistol according to the invention in a standby or non-use position. In this position, the barrel 4 has recoiled completely into the frame 1 and covers the opening 8 towards the receiving cavity 6 for receiving cartridges.

FIG. 5 illustrates the first arming that is performed manually after having introduced a magazine 9 in place in its housing inside the butt 2 of the pistol so that it communicates with the receiving cavity 6 for receiving cartridges 7 by means of the opening 8. The magazine is schematically shown here by means of a series of cartridges 7 arranged parallel to axis A-A of the barrel 4.

After having unlocked the locking device 37, the barrel 4 is pulled forward against the action of the recoil spring 29 to clear the opening 8 for the purpose of allowing a cartridge to move up into the receiving cavity 6 while at the same time it is centered with the aid of the two lugs 46, 47 and of the loop 45 of the ejector plate 44. The projection of the side lug 47 is then located behind the ridge of the case.

At the same time, the lug 43 at the back end of the barrel 4 will drive the lug 42 of the pivoting lever 40 which will pivot, pushing the link 19 which will then pivot the striker 11 to its armed and locked position by means of the entrance of the guiding pin 22 into the vertical side of the L-shaped slot 21 of the link 19.

When the barrel 4 is released, the recoil spring 29 is in a compressed state and will again push the barrel until reloading the cartridge 7 that is waiting in standby inside the receiving cavity 6, which is illustrated in FIG. 6. The pistol is then ready for the first shot.

FIG. 7 schematically illustrates the moment directly after the striking. Here, the trigger 10 has been pressed, causing the actuating arm 15 to pivot upwards pushing with its cam 24 against the lug 25 of the link 19 which is then slightly raised such that the guiding pin 22 is located inside the horizontal side of the L-shaped slot and the striker 11 is released, pushing back the link under the action of the spring 12. The striking end of the striker then penetrates the hole 31 of the rear wall 30 of the receiving cavity to strike the cartridge 7 which is located inside the firing chamber 5 of the barrel 4.

The primer of the cartridge is thus ignited and triggers an ex plosive combustion inside the chamber. The bullet 7' is shot out while at the same time driving the barrel by friction between the inner wall thereof and the bullet. On the other hand, the barrel is preferably striated in a conventional manner for the purpose of transmitting rotation to the bullet in order to stabilize it during flight.

During the movement of the barrel towards its forward position, the ejector plate 44 is driven by the barrel 4 a small distance determined by the length of its guiding slots 48 so that its elastic loop 45 is no longer opposite the side lug 47 on the rear wall 30 of the receiving cavity 6 so as to be able to eject the case 7' from the cavity as soon as the ejection port 8' is clear. As soon as the case 7' is ejected, a new cartridge 7 moves up into the receiving cavity 6 to be loaded when the barrel 4 returns to its recoiled position by the effect of the action of the recoil spring 29.

Subsequently, rearming is performed automatically when the barrel moves towards its forward position, pivoting the pivoting lever 40.

FIGS. 8 to 13 and 15A to 15B show an embodiment of a magazine 9 suitable for the pistol according to the invention. The magazine comprises a raising plate 51 for raising the cartridges which is constantly biased upwards by a pressure spring 52. In its upper portion, the magazine 9 is recessed to allow only one cartridge 7 to pass into the receiving cavity 6 at a time. The upward opening is covered by a rotary member 53 having the shape of a retractable stirrup.

The retractable stirrup 53 is shown in FIG. 15A in its closed position and in FIG. 15B in its open position. The two parallel sides of the stirrup are pivotably mounted on both sides of the opening at the top end of the magazine 9.

One of the sides of the stirrup 53 is provided with a leg 53' extending downwardly to penetrate a guiding slot 9 provided on the upper portion of the magazine 9. This leg 9 is suitable for cooperating with an elastic member in the form of a wire form spring 54 arranged inside the gap 2' of the butt 2 that receives the magazine 9.

One of the ends of the wire form spring 54 is supported against the leg 53' of the stirrup 53 during the placement of the magazine inside the butt 2 so as to pivot the stirrup 53 from its closed position shown in FIG. 15A to its open position shown in FIG. 15B. The magazine 9 is therefore kept open while inside the butt 2.

It should be noted that the cartridges are stored inside the magazine such that their longitudinal axis is parallel to axis A-A of the barrel when the magazine is inserted in the butt 2 of the pistol.

Loading cartridges into the magazine is considerably facilitated because the cartridges can be introduced into the magazine being supported on the top on each cartridge and not like in conventional magazines pushing it from behind. For each introduction of a new cartridge 7 into the magazine 9, the stirrup 53 should be closed manually to retain the cartridges inside the magazine.

The raising plate 51 has in the front portion on its upper face a gap 55 that can be arranged opposite a slot (not depicted) on the front wall of the magazine when the plate 51 is mounted in its highest position after shooting the last cartridge from the magazine. An abutment member in the form of a shaft 56 slidably mounted inside the frame 1 is arranged in front of the magazine and comprises at its top end a hook 57 projecting into the slot of the magazine. The shaft 56 is provided at its bottom end with an oblong bore 58 that receives a pin 59 demarcating the movement of the shaft.

When the last cartridge from the magazine 9 has been shot, the hook 57 enters the gap of the raising plate and pulls the shaft 56 upwards such that the rear face of the hook forms an abutment for the barrel 4 when it returns from its forward position after shooting the last cartridge. The pistol is then in the state shown in FIG. 12 with the striker 11 armed, the barrel abutting against the shaft 56 and the ejection port 8' is kept open towards the receiving cavity 6. The shooter can then push a button 60 (see FIG. 14) to release the magazine for the purpose of being able to remove and load it again with cartridges or for replacing it with another one containing cartridges.

Moreover, during its operation the but ton 60 is suitable for being supported on the leg 53' of the stirrup 53 for the purpose of pivoting it towards its closed position.

After a new cartridge has moved up into the receiving cavity 6, the shooter pulls the shaft 56 downwardly by acting on a handle 61 such that the top end of the shaft retracts to release the barrel 4 which is then pushed back by the recoil spring 29.

If a cartridge 7 located inside the firing chamber 5 is to be removed, the barrel should be pulled towards its forward position and the handle 61 pushed upwards to prevent, with the aid of the abutment shaft 56, the barrel from returning completely to its recoiled position for the purpose of making the cartridge accessible through the ejection port 8'.

The pistol is advantageously provided with a conventional safety mechanism which locks the striker 11 by acting on the link 19 from outside to lock it with the aid of a small locking lever 62 on the side of the pistol. This lever can be turned in one direction or the other to lock and unlock the striker.

The pistol according to the invention has the following advantages:

- simplified and more reliable mechanism for arming and retaining the striker;
- simplified striking mechanism;
- smaller number of parts as a result of eliminating the moving grip and the firing pin;

no ramp for loading cartridges into the firing chamber, the cartridges always being kept parallel to the axis of the barrel;

improved shooting precision;

improved power and increased range of the bullet;

less recoil;

no outer part except the striker is in movement when shooting;

lighter weight pistol;

easy maintenance;

lower manufacturing cost.

The invention is evidently not limited to the example illustrated in the drawings and the person skilled in the art will devise variants without departing from the scope of the invention.

The invention claimed is:

1. A semi-automatic pistol comprising:

a frame, wherein a barrel is arranged in said frame and a firing chamber of which is associated with a receiving cavity for receiving a cartridge, said receiving cavity being provided with a downwards opening to communicate with a magazine, and with a side ejection port associated with a mechanism for extracting and ejecting a case after shooting; and a firing mechanism comprising a striker mounted so that said striker can pivot in a rear portion of the pistol and suitable to initiate firing the cartridge inside the firing chamber, and a trigger integral with an actuating arm which acts on a means for arming and retaining the striker in an armed position, wherein the barrel is mounted in an axially slidable manner between a forward position to which said barrel is driven by friction of a bullet when firing the cartridge, and a recoiled position to which said barrel is pushed by a recoil spring until reloading a new cartridge, said means for arming and retaining the striker comprising a link which at a back end thereof is connected to the striker by means of an articulation and which is operated by means of a lever pivotably mounted inside the frame, said lever having a top end operated by the barrel during movement of said barrel to said forward position in order to pivot said lever, and a bottom end forming a cam that acts on said link during pivoting of said lever, pushing said lever back so as to rearm the striker.

2. The semi-automatic pistol according to claim 1, wherein the barrel acts on said top end of said lever by means of a projection provided at aback end of said lever hitting against said lever such that said lever is pivoted forward.

3. The semi-automatic pistol according to claim 1, wherein said link is provided with an L-shaped guiding slot, wherein a large side of said slot extends horizontally and a small side of said slot extends vertically upwards, a guiding pin incorporated in the frame extending inside said L-shaped guiding slot such that said guiding pin allows the link to carry out a translatory motion towards the back for arming the striker while at the same time said link is subjected to action of a spring that downwardly bias said link such that said guiding pin is housed inside said small side so as to retain said link in an armed position of the striker.

4. The semi-automatic pistol according to claim 3, wherein said link can be released from said armed position by means of a nose which forms a cam provided at a back end of the actuating arm and which is suitable for abutting on an underside against the link to push said link upwards.

5. The semi-automatic pistol according to claim 1, wherein said actuating arm incorporates an elastic member which projects upwards and during pivoting thereof abuts against a lug provided on said link such that together said lug and said elastic member form a flexible stop.

6. The semi-automatic pistol according to claim 5, wherein said elastic member is a wire spring.

7. The semi-automatic pistol according to claim 1, wherein a rear wall of the receiving cavity for receiving the cartridge is provided with a hole centered on the firing chamber and which allows the striker to strike the cartridge inside the firing chamber directly through said hole.

8. The semi-automatic pistol according to claim 7, wherein a striking end of the striker has an overall conical shape complementary to an inner shape of said hole.

9. The semi-automatic pistol according to claim 1, wherein the barrel slides inside a cylindrical gap formed inside the frame being guided by a collar provided in a periphery of the barrel and by an end part with a central guiding bore arranged in a front end of the pistol.

10. The semi-automatic pistol according to claim 9, wherein the recoil spring is a helicoidal spring arranged inside an annular interstice formed between said cylindrical gap and the barrel, being supported on said collar of the barrel on one side and on said end part on another side.

11. The semi-automatic pistol according to claim 1, wherein the mechanism for extracting and ejecting the case after shooting comprises an ejector plate arranged opposite the ejection port and one end of said ejector plate is connected to the barrel and another end of said ejector plate has an elastic loop that extends radially and is suitable for being compressed by the cartridge as the cartridge moves up into the receiving cavity for receiving the cartridge.

12. The semi-automatic pistol according to claim 11, wherein the ejector plate has at least one longitudinal guiding slot that receives a guiding pin so as to limit axial movement of said ejector plate to an extraction position.

13. The semi-automatic pistol according to claim 1, wherein in order to center the cartridge as the cartridge moves up into the receiving cavity, a rear wall of said cavity is provided with a first lug arranged so as to form an upper abutment, and with a second lug arranged so as to form a side abutment.

14. The semi-automatic pistol according to claim 13, wherein said second lug is provided with a projection suitable for being placed behind a ridge of the cartridge so as to form a member for extracting the case after shooting.

15. The semi-automatic pistol according to claim 1, wherein the magazine is closed at a top end thereof by a rotary closure member having a shape of a stirrup two parallel sides of which are shown to be pivoting on the top end of the magazine.

16. The semi-automatic pistol according to claim 15, wherein one side of the stirrup incorporates a leg directed downwards to penetrate a guiding slot provided at the top end of the magazine, and said leg is suitable for cooperating with an elastic member provided inside the gap for receiving the magazine for pivoting the rotary closure member to an open position.

17. The semi-automatic pistol according to claim 1, wherein an abutment member in a form of a shaft is mounted such that said shaft slides upwards and downwards to project into the receiving cavity when said shaft is in an upper position, such that said shaft prevents the barrel from returning to said recoiled position so that the ejection port is kept open towards the receiving cavity.

18. The semi-automatic pistol according to claim 17, wherein the shaft forming said abutment member is arranged in front of the magazine and said shaft comprises a hook at a top end of said shaft, said hook projecting into a slot of the magazine to cooperate with a raising plate for raising cartridges in order to move the shaft upwards after shooting a last cartridge inside the magazine.

* * * * *